United States Patent [19]

Tabuchi et al.

[11] 4,210,884

[45] Jul. 1, 1980

[54] HELICAL RESONATOR BAND PASS FILTER WITH NOVEL COUPLING MEANS

[75] Inventors: Toshihide Tabuchi, Hirakata; Masakatsu Tsumura, Shijonawate, both of Japan

[73] Assignee: Matsushita Electric Industrial Co., Ltd., Kadoma, Japan

[21] Appl. No.: 912,255

[22] Filed: Jun. 5, 1978

[30] Foreign Application Priority Data

Jun. 3, 1977 [JP] Japan ..... 52-66146
Feb. 8, 1978 [JP] Japan ..... 53-15108

[51] Int. Cl.[2] ..... H01P 7/00; H01P 5/00; H01P 1/20

[52] U.S. Cl. ..... 333/203; 333/212; 333/219

[58] Field of Search ..... 333/73 R, 73 C, 73 S, 333/73 W, 82 B, 82 R, 83, 202, 208–209, 212, 219, 222–223, 227–229, 230–235

[56] References Cited

U.S. PATENT DOCUMENTS 3,293,644 12/1966 Loos et al. ..... 333/73 R
3,337,791 8/1967 Barton et al. ..... 333/82

FOREIGN PATENT DOCUMENTS 114597 7/1940 Australia ..... 333/73 C
538439 3/1957 Canada ..... 333/73 C
2262983 7/1973 Fed. Rep. of Germany ..... 333/73 R

OTHER PUBLICATIONS

Sverev et al., "Realization of a Filter with Helical Components" in IRE Trans. on Component Parts, Part 8, No. 3, Sep. 1961, pp. 99–110.
Macalpine et al., "Resonators with Helical Inner Conductor" in Proceedings of the IRE, Dec. 1959, pp. 2099–2104.

*Primary Examiner*—Alfred E. Smith
*Assistant Examiner*—Marvin Nussbaum
*Attorney, Agent, or Firm*—Wenderoth, Lind & Ponack

[57] ABSTRACT

In a band pass filter having a plurality of helical resonators each including a quarter-wavelength winding, at least two of the helical resonators are substantially shielded from each other by a partition wall, while the corresponding two quarter-wavelength windings which are shielded from each other are electrically connected to each other through a lead line which is insulated from the shield casing, thereby improving the cut off characteristic of the filter to cut off the applied signal more rapidly in the high frequency region of the band being filtered than in the low frequency region.

11 Claims, 19 Drawing Figures

Fig. 8 (a)
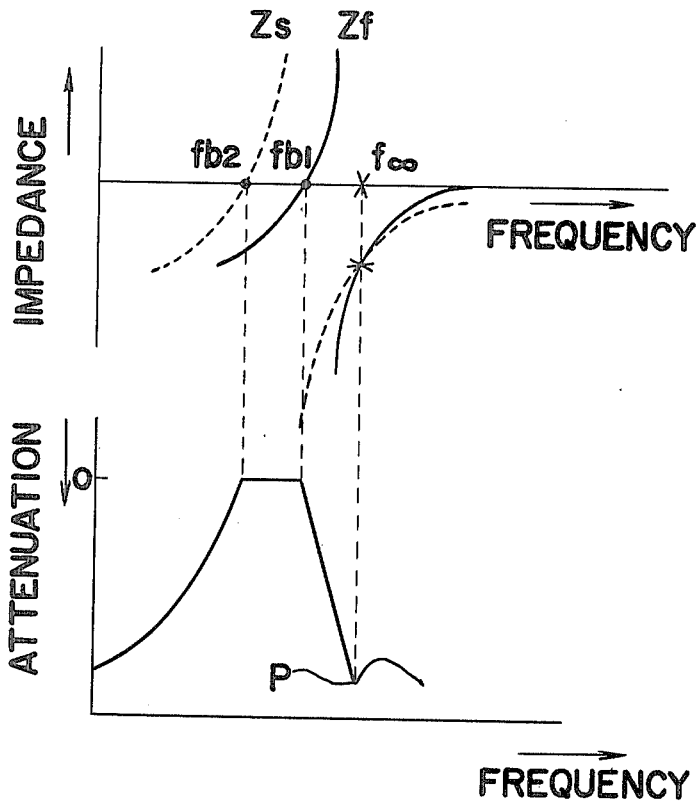
Fig. 8 (b)
Fig. 9
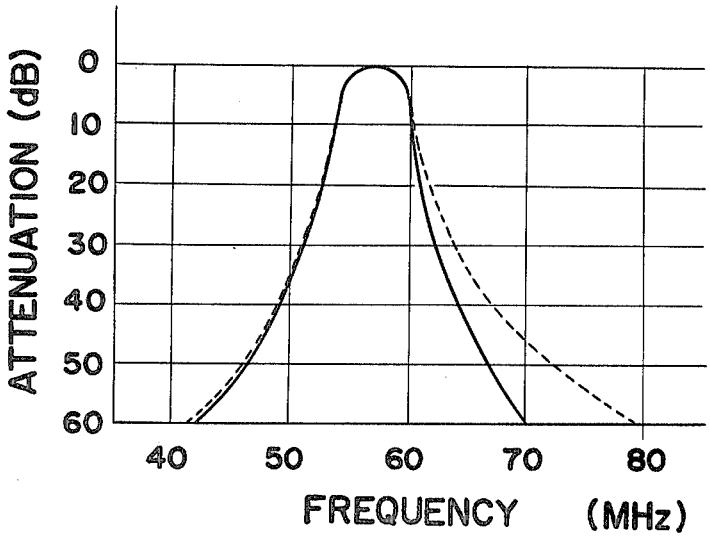

HELICAL RESONATOR BAND PASS FILTER WITH NOVEL COUPLING MEANS

BACKGROUND OF THE INVENTION

The present invention relates to a band pass filter having a plurality of helical resonators each including a quarter-wavelength winding and, more particularly, to an improved type of band pass filter having a sharper cut off characteristic in the high frequency region than in the low frequency region of the band being filtered.

The band pass filter of the above described type is employed, for example, in a television receiver set as an intermediate frequency filter. In a television receiver set, the frequency $f_p'$ of the adjacent channel video carrier wave and the frequency $f_s'$ of the adjacent channel audio carrier wave must be attenuated by more than 50 dB relative to the intermediate frequency $f_0$. Since in the televised signal, the relation between the frequencies $f_0$, $f_s'$ and $f_p'$ is such that $f_p'<f_0<f_s'$ and $f_0-f_p'>f_s'-f_0$, it is necessary to cut off the filter response more sharply in the high frequency region.

Conventionally, there have been proposed a number of band pass filters, and one of these is described hereinbelow with reference to FIGS. 1, 2 and 3 which show a partly cut-away perspective view, a sectional side view and an equivalent circuit diagram of the conventional band pass filter, respectively.

In FIGS. 1 and 2, the band pass filter shown includes a shield casing 1 having an elongated rectangular cubic body made of metallic plate such as aluminum which is divided into a plurality of rooms 3 by partition walls 2. Each of the partition walls 2 has a coupling opening 4 formed therein which interconnects the neighboring rooms for the purpose of aperture coupling. In each of the rooms 3, there is provided a quarter-wavelength winding 5 constituted by a coil of electrically conductive material such as copper having a few dozen turns. One end of each coil 5 is rigidly connected to a bottom wall of the casing 1 while the other end of the coil 5 is free of any of the walls. Each of the two rooms which are located at the opposite ends of the casing 1 accommodates an additional coil 6 or 7 of a type similar to that described above but having only a few turns for the purpose of loop coupling. The additional coil 6 housed in the left-hand room 3 is provided for receiving input signals from an input circuit (not shown) while the additional coil 7 housed in the righthand room 3 is provided for producing a filtered signal to an output circuit (not shown). As apparent from FIG. 2, each of the auxiliary coils 6 and 7 has one end extending outwardly from the casing 1 through a suitable insulating support 8, and the other end rigidly connected to the bottom wall of the casing 1 within the associated room 3.

The circuit diagram shown in FIG. 3 is an equivalent circuit for the band pass filter shown in FIG. 2. The parallel circuits each composed of an inductor $L_a$ and a capacitor $C_a$ correspond to the quarter-wavelength windings 5, while each of the capacitors $C_b$ corresponds to the coupling capacitance established between the neighboring quarter-wavelength windings 5 through the coupling opening 4.

So far as the propagation characteristics of any one of the parallel circuits constituted by an inductor $L_a$ and a capacitor $C_a$ is considered, it is understood that the impedance of the resonance circuit ($L_a$ and $C_a$) drops gradually down to zero in the frequency region above the resonance frequency (hereinafter referred to as the high frequency region) and in the frequency region below the resonance frequency (hereinafter referred to as the low frequency region) since the propagation loss in the resonance circuit increases with an increase in frequency and since the resonance circuit has a definite quality factor Q. When a number of resonance circuits are coupled in series through the coupling openings 4 as described above, it is found that the cut off characteristic in the high frequency region becomes less and less sharp as the coupling capacitance of the capacitor $C_b$ increases, that is, as the distance between the neighboring quarter-wavelength windings becomes smaller or as the coupling opening 4 becomes larger.

Accordingly, as shown by the broken line curve in the graph of FIG. 9 in which the abscissa represents frequency and the ordinate represents attenuation, the conventional band pass filter of the above described type employing quarter-wavelength windings cuts off more gradually in the high frequency region than in the low frequency region.

SUMMARY OF THE INVENTION

Accordingly, it is a primary object of the present invention to provide an improved type of band pass filter employing quarter-wavelength windings which cuts off signals sharply in the high frequency region.

Another object of the present invention is to provide a band pass filter of the above described type which is simple in construction and readily manufactured at low cost.

In accordance with a preferred embodiment of the invention, a band pass filter is constituted by a shield casing made of metallic plate and having at least two rooms separated by a partition wall made of metallic plate with a quarter-wavelength winding insulated from the casing housed in each of the rooms. More particularly, the first end of the quarter-wavelength winding is rigidly supported within the casing and electrically insulated from the casing and the second end thereof is free of the casing. The first end of the quarter-wavelength winding housed in one room is connected through a lead line, insulated from the shield casing, to the first end of the quarter-wavelength winding housed in the other room. The band pass filter of the present invention further comprises means for supplying input signals to one room for filtering the input signals in a particular frequency region through the quarter-wavelength windings housed in the two rooms and means for producing filtered signals from the other room.

BRIEF DESCRIPTION OF THE DRAWINGS

These and other objects and features of the present invention will become apparent from the following description of preferred embodiments thereof with reference to the accompanying drawings, in which:

FIG. 8(*a*) is a graph showing the impedance characteristics of the circuits shown in FIGS. 7(*b*) and 7(*c*);

FIG. 8(*b*) is a graph showing the attenuation characteristic of the circuit shown in FIG. 7(*a*);

FIG. 9 is a graph showing the attenuation characteristics of the circuits shown in FIGS. 4 and 5;

DETAILED DESCRIPTION OF THE INVENTION

Figure 1:
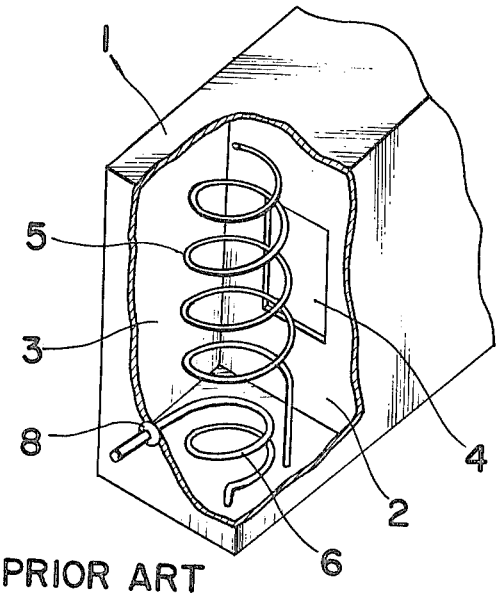
Fig. 1 PRIOR ART
FIGS. 1, 2 and 3 are drawings already referred to in the foregoing description, FIG. 1 being a cut-away perspective view of the conventional band pass filter, FIG. 2 being a sectional side view of the band pass filter shown in FIG. 1 and FIG. 3 being an equivalent circuit diagram of the band pass filter shown in FIGS. 1 and 2.
Figure 2:
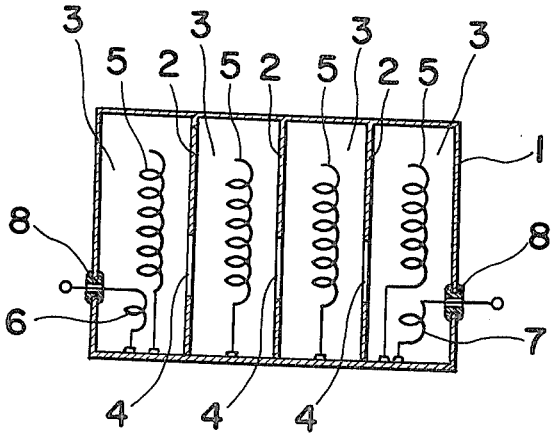
Fig. 2 PRIOR ART

Before the description of the present invention proceeds, note that like parts are designated by like reference numerals throughout the accompanying drawings.

Figure 4:
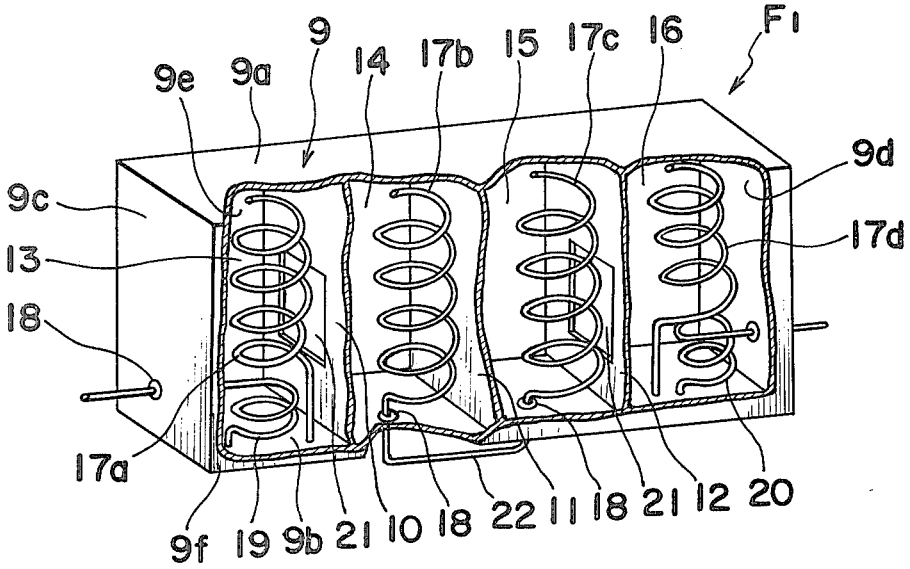
FIG. 4 is a partly cut-away perspective view of a band pass filter according to one embodiment of the present invention.
Figure 5:
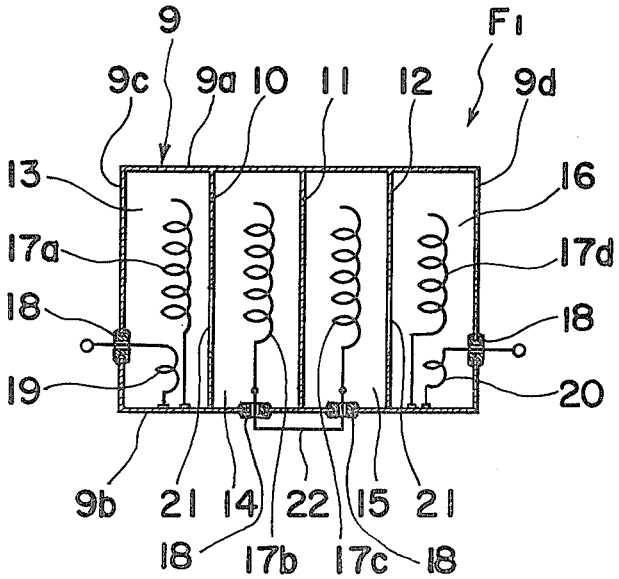
FIG. 5 is a schematic sectional side view of the band pass filter shown in FIG. 4.

Referring to FIGS. 4 and 5, one embodiment of the band pass filter of the present invention comprises an shield casing 9 having an elongated box-like configuration formed of metallic plate such as aluminum having a top wall 9*a*, a bottom wall 9*b*, a pair of the opposite side walls 9*c*, a 9*d* and front wall 9*e* and a rear wall 9*f*. The shield casing 9 is divided into a plurality of rooms, for example, four rooms 13 14, 15 and 16, by parallel partition walls 10, 11 and 12 which are also formed by the metallic plate such as aluminum. The partition wall 10 positioned between the rooms 13 and 14 and the partition wall 12 positioned between the rooms 15 and 16 each have a coupling opening 21 formed therein for interconnecting the neighboring rooms. In contrast the partition wall 11 positioned between the rooms 14 and 15 completely separates the neighboring rooms.

Provided in the rooms 13 to 16 are quarter-wavelength windings 17*a*, 17*b*, 17*c* and 17*d* respectively, each constituted by a helical coil of electrically conductive material such as copper having a few dozen turns. One end of each coil or quarter-wavelength winding is rigidly mounted on the bottom wall 9*b* of the casing within the associated room while the other end thereof is free of any of the walls. Note that the coils 17*a* and 17*d* housed in the rooms 13 and 16 located at the opposite ends of the casing have one end mounted on the bottom wall 9*b* and electrically connected to the casing while each of the coils or quarter-wavelength windings 17*b* and 17*c* housed in the rooms 14 and 15 located in intermediate rooms of the casing have their end which is mounted on the bottom wall 9*b* electrically insulated from the casing by a suitable insulating support 18 mounted in the bottom wall 9*b*. The coils 17*b* and 17*c* are electrically connected to each other through an external lead line 22 extending along the bottom wall of the casing and having its opposite ends connected to the ends of the coils 17*b* and 17*c* which are mounted on the bottom wall 9*b*. The lead line 22 is insulated from the casing 9. Each combination of a room and its associated quarter-wavelength winding is termed a helical resonator.

Each of the rooms 13 and 16 located at the opposite ends of the casing 9 accommodates an additional or auxiliary coil of a type similar to the coil of each helical resonator, but having only a few turns, and positioned in such a manner as to be inductively coupled to the quarter-wavelength windings. The auxiliary coil 19 housed in the left-hand room 13 is provided for receiving input signals from an input circuit (not shown) while the auxiliary coil 20 housed in the right-hand room 16 is provided for producing a filtered signal to an output circuit (not shown). Each of the auxiliary coils has one end extending out of the casing 9 through a suitable insulating support 18 for external electric connection thereto, while the other end of the auxiliary coil is rigidly and electrically connected to the bottom wall 9*b* within the associated room.

Note that the resonating signals produced from the quarter-wavelength windings 17*a* and 17*c* propagate through the coupling opening 21 to the respective neighboring helical resonator, while the resonating signal produced from the helical resonator having quarter-wavelength winding 17*b* is transmitted to the neighboring helical resonator having quarter-wavelength winding 17*c* mainly through the lead line 22 where the electric field is very weak since the rooms 14 and 15 are completely isolated from each other in terms of electric field. This resonance signal transmission through the band pass filter of the present invention as described above is discussed in greater detail hereinbelow with reference to FIGS. 6 to 9.

Figure 6:
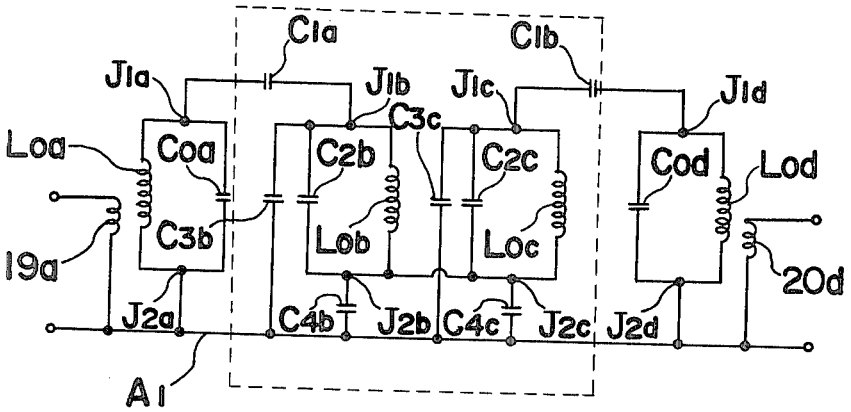
FIG. 6 is an equivalent circuit diagram of the band pass filter shown in FIGS. 4 and 5.

Referring to FIG. 6, there is shown an equivalent circuit of the band pass filter described above. The equivalent circuit includes an inductor $L_{0a}$ having an inductance equivalent to that of the coil 17*a* and a capacitor $C_{0a}$ connected in parallel to the inductor $L_{0a}$ between junctions $J_{1a}$ and $J_{2a}$ having a capacitance equivalent to the coil 17*a*. In the same manner, a parallel circuit of inductor $L_{0d}$ and capacitor $C_{0d}$ equivalent to the coil 17*d* is connected between junctions $J_{1d}$ and $J_{2d}$. An inductor $L_{0b}$ having an equivlaent inductance to that of the coil 17*b* is connected between junctions $J_{1b}$ and $J_{2b}$ and a capacitor $C_{2b}$ having a capacitance equivalent to the distributed capacitance of the coil 17*b* is connected in parallel to the inductor $L_{0b}$. Likewise, an inductor $L_{0c}$ having an inductance equivalent to that of the coil 17*c* and a capacitor $C_{2c}$ having a capacitance equivalent to the distributed capacitance of the coil 17*c* are connected in parallel to each other between junctions $J_{1c}$ and $J_{2c}$. The junctions $J_{2a}$ and $J_{2d}$ are connected to a common lead line $A_1$ which corresponds to the casing 9, whereas the junctions $J_{2b}$ and $J_{2c}$ are connected to each other through a line equivalent to lead line 22 and also to the common lead line $A_1$ through capacitors $C_{4b}$ and $C_{4c}$, respectively. Each of capacitors $C_{4b}$ and $C_{4c}$ has a capacitance equivalent to the distributed capacitance between the casing 9 and the respective coils and between the casing 9 and the lead line 22. The junctions $J_{1a}$ and $J_{1b}$ are connected to each other through a capacitor $C_{1a}$ having a capacitance equivalent to the coupling capacitance between the neighboring resonators having coils 17*a* and 17*b* through the opening or aperture 21 and, likewise, the junctions $J_{1c}$ and $J_{1d}$ are connected to each other through a capacitor $C_{1b}$ having a capacitance equivalent to the coupling capacitance between the neighboring helical resonators having coils 17*c* and 17*d* through the opening 21. A capacitor $C_{3b}$ is connected between the junction $J_{1b}$ and the common lead line $A_1$ while a capacitor $C_{3c}$ is connected between the junction $J_{1c}$ and the common lead line $A_1$. Each of these capacitances $C_{3b}$ and $C_{3c}$ has a capacitance equivalent to the distributed capacitance between the respective coils and the casing 9, particularly, the upper wall 9a. Coils 19a and 20d correspond to the auxiliary coils 19 and 20 described above.

Figure 3:
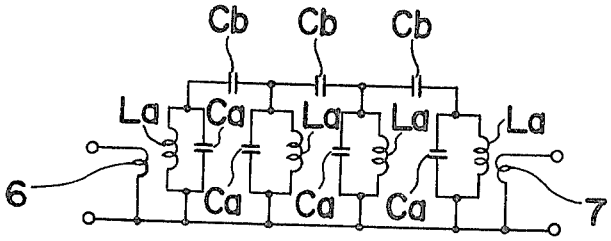
Fig. 3 PRIOR ART

Since the circuit components shown outside of the broken line in FIG. 6 are similar to those of FIG. 3, a detailed description thereof is omitted for the sake of brevity.

The transmission characteristics of the circuit enclosed by the broken line in FIG. 6 will now be described by way of the bisection theory with reference to FIGS. 7(*a*), 7(*b*) and 7(*c*).

Figure 7:
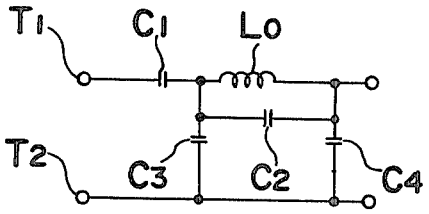
FIGS. 7(*a*), 7(*b*) and 7(*c*) are circuit diagrams presented for explaining the circuit diagram shown in FIG. 6.
Figure 7:
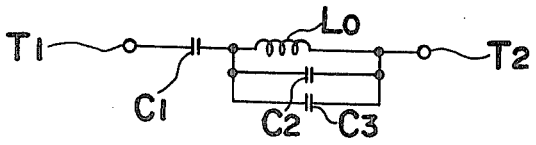
Figure 7:
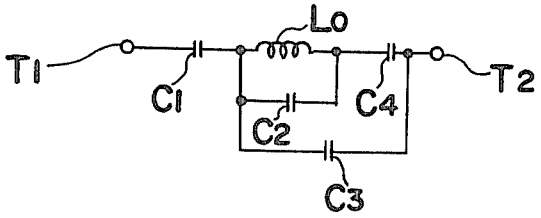

FIG. 7(*a*) is a circuit diagram of the left-hand half of the circuit shown inside the broken line of FIG. 6 with reference characters employed in general form indicating the value of the respective elements. FIG. 7(*b*) is a circuit diagram showing the short circuit impedance $Z_s$ and FIG. 7(*c*) is a circuit diagram showing the open-circuit impedance $Z_f$ between input terminals $T_1$ and $T_2$ of the circuit shown in FIG. 7(*a*). With reference to these circuits shown in FIGS. 7(*a*), 7(*b*) and 7(*c*), the upper limit frequency $f_{b1}$ and the lower limit frequency $f_{b2}$ of the band pass filter and also the frequency $f_\infty$ which provides infinite attenuation can be calculated as given hereinbelow.

Since the frequency $f_\infty$ is obtained when the short-circuit impedance $Z_s$ is equal to the open-circuit impedance $Z_f$, the following equation (1) can be obtained:

$$f_\infty = (1/2\pi\sqrt{L_0C_2}) \quad (1)$$

Since the upper limit frequency $f_{b1}$ is obtained when the open-circuit impedance $Z_f$ is equal to zero, the following equation (2) can be obtained:

$$f_{b1} = \frac{1}{\sqrt{1 + \frac{C_4(C_1 + C_3)}{C_2(C_1 + C_3 + C_4)}}} \cdot f_\infty \quad (2)$$

Since the lower limit frequency $f_{b2}$ is obtained when the short-circuit impedance $Z_s$ is equal to zero, the following equation (3) can be obtained:

$$f_{b2} = \frac{1}{\sqrt{1 + \frac{C_1 + C_3}{C_2}}} \cdot f_\infty \quad (3)$$

Since in a band pass filter employing helical resonators, the capacitance of each of the capacitors $C_1$, $C_3$ and $C_4$ is lower than that of the capacitor $C_2$, it is understood that:

$$f_{b2} \lesssim f_{b1} \lesssim f_{28}$$

Therefore, the relation between impedance $Z_s$ and the frequency is as illustrated by the broken would give such curves as represented by broken line curve in the graph of FIG. 8(*a*), whereas the relation between the impedance $Z_f$ and the frequency is as illustrated by the solid line curve in the same graph in which the abscissa represents frequency and the ordinate represents impedance. Thus, the transmission characteristic of the circuit enclosed by the broken line in FIG. 6 is as shown in the graph of FIG. 8(*b*), in which the abscissa represents frequency and the ordinate represents attenuation. As apparent from the graph of FIG. 8(*b*), it is understood that the attenuation rapidly increases in the frequency region adjacent to and higher than the upper limit frequency $f_{b1}$ towards an attenuation pole indicated by reference character P.

The transmission characteristic of the band pass filter of the present invention is shown by the solid curve in the graph of FIG. 9 in comparison with that of the conventional band pass filter represented by the broken line. As understood by those skilled in the art, the band pass filter of the present invention has an improved transmission characteristic in the high frequency region to more sharply cut off the signal with respect to that in the low frequency region.

Each of the quarter-wavelength windings or coils described above may be wired around a bobbin or the like or around a hollow core. In this case, the type of winding around the bobbin or hollow core is preferably a pitch winding or a series winding.

In general, the helical resonator constituted by the coil of copper wire or the like and the associated room is likely to resonate at harmonics having frequencies $f_0 \cdot (2n+1)$, in which $f_0$ is the fundamental resonating frequency and n is any positive integer. Therefore, the resonator resonates at these frequencies $f_0 \cdot (2n+1)$ to produce spurious mode signals. In order to eliminate these harmonics, wire capable of cutting off high frequencies such as iron plated copper wire is helically wound to constitute the coil or quarter-wavelength winding. Preferably, the thickness of the iron plating on the copper wire is 3 to 10 μm. With this arrangement, the helical resonator has a feature that decreases the quality factor Q in the high frequency region and thus decreases the characteristic impedance. Therefore, the resonator functions as if a low impedance load were connected in the high frequency region to increase the loss in the high frequency region. In other words, the increase of the loss suppresses the spurious mode signals.

In a similar manner, the casing 9 made of a highly electrically conductive material such as aluminum or copper may be finished with 3 to 10 μm thick iron plating for further suppressing the spurious mode signals.

Figure 10:
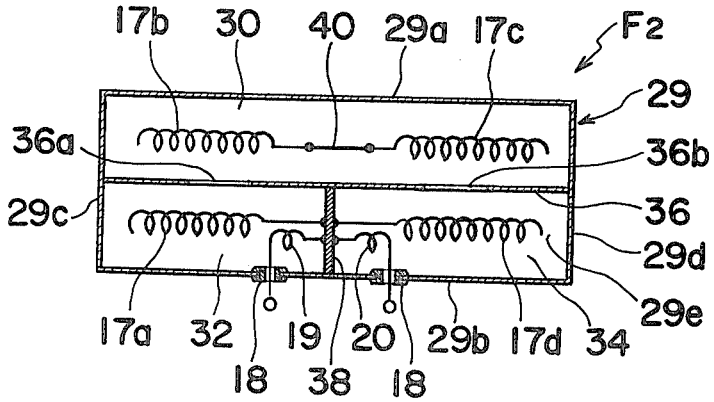
FIG. 10 is a schematic sectional side view of a band pass filter according to another embodiment of the present invention.

Referring now to FIG. 10, there is shown a band pass filter $F_2$ according to a second embodiment of the present invention. The band pass filter $F_2$ of this embodiment comprises a shield casing 29 having an elongated box-like configuration formed of metallic plate such as aluminum and having a top wall 29a, a bottom wall 29b, a pair of the opposite side walls 29c and 29d and front and rear walls (only the rear wall 29e is shown in FIG. 10). The casing 29 is divided into three rooms; one half size room 30 and two quarter size rooms 32 and 34. These three rooms are defined by a center partition wall 36 extending between the side walls 29c and 29d and a partition wall 38 extending between the center partition wall 36 and the bottom wall 29b. Note that the center partition wall 36 has two openings 36a and 36b, the opening 36a interconnecting the rooms 32 and 30 and the opening 36b interconnecting the rooms 30 and 34. A supporting wall 40 extends approximately in the center of the half size room 30 between the front and rear walls for supporting the quarter-wavelength windings or coils in a manner described hereinbelow.

Provided in the rooms 30, 32 and 34 are four quarter-wavelength windings 17a, 17b, 17c and 17d. The quarter-wavelength windings 17a is accommodated in the room 32 and has one end rigidly mounted on and electrically connected to the partition wall 38 and the other end thereof spaced apart from any of the walls constituting the room 32. In the same manner, the quarter-wavelength winding 17*d* is accommodated in the room 34.

The quarter-wavelength winding 17*b* accommodated in the left-hand side portion of the room 30 has one end rigidly connected to the supporting wall 40 while the other end thereof is spaced apart from any of the walls constituting the room 30. The quarter-wavelength winding 17*b* extends approximately in parallel relation to the quarter-wavelength winding 17*a* and faces the same through the opening 36*a*. Note that the quarter-wavelength winding 17*b* is electrically insulated from the supporting wall 40, i.e., the casing 29. In the same manner, the quarter-wavelength winding 17*c* is accommodated in the right-hand of the room 30. Note that the quarter-wavelength windings 17*b* and 17*c* are electrically connected to each other by a suitable conducting means extending along the supporting wall 40.

Each of the rooms 32 and 34 accommodates an additional or auxiliary coil. The auxiliary coil 19 housed in the room 32 is positioned in such a manner as to be inductively coupled to the quarter wave-length winding 17*a* and is provided for receiving input signals from an input circuit (not shown), while the auxiliary coil 20 housed in the room 34 is positioned in such a manner as to be inductively coupled to the quarter-wavelength winding 17*d* and is provided for producing a filtered signal to an output circuit (not shown). Each of the auxiliary coils has one end extending outwardly from the casing 19 through a suitable insulating support 18 for external electric connection thereto, while the other end of the auxiliary coil is rigidly and electrically connected to the partition wall 38.

The band pass filter $F_2$ of the type described with reference to FIG. 10 is particularly arranged to form a half-wavelength winding in the room 30 by a linear arrangement of the two quarter-wavelength windings 17*b* and 17*c*. This arrangement serves to cut off the signals in the high frequency region in a manner similar to that described above in connection with the band pass filter according to the first embodiment.

Figure 11:
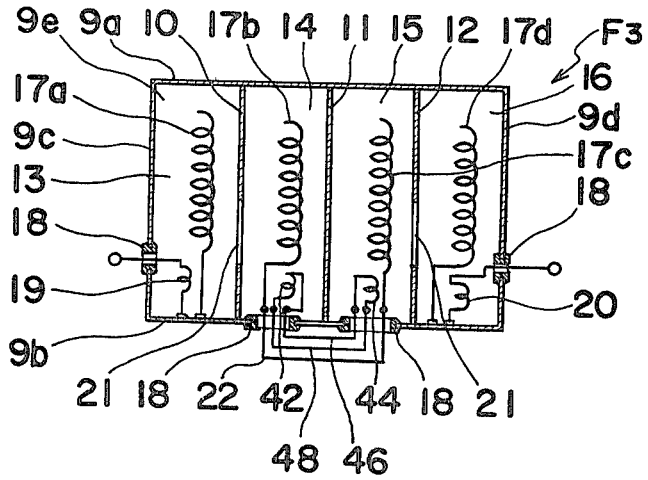
FIGS. 11 to 14 are views similar to FIG. 5, but particularly showing other embodiments of the present invention.

Referring to FIG. 11, there is shown a band pass filter $F_3$ which is a modification of the band pass filter $F_1$ described above with reference to FIGS. 4 and 5. The band pass filter $F_3$ of this modification further comprises additional coils 42 and 44 which are accommodated in the rooms 14 and 15, respectively, in such a manner as to be inductively coupled to the respective quarter-wavelength windings. The end of the additional coil 42 which is located closely adjacent the end of the coil 17*b* is connected to the end of the other additional coil 44 which is located closely adjacent the end of the coil 17*c*, through an external lead line 46 extending along the bottom wall 9*b* of the casing. The lead line 46 is insulated from the casing 9. Likewise, the end of the additional coil 42 which is remote from the coil 17*b* is connected to the end of the other additional coil 44 which is remote from the coil 17*c*, through an external lead line 48 also extending along the bottom wall 9*b* and insulated from the casing 9.

Figure 12:
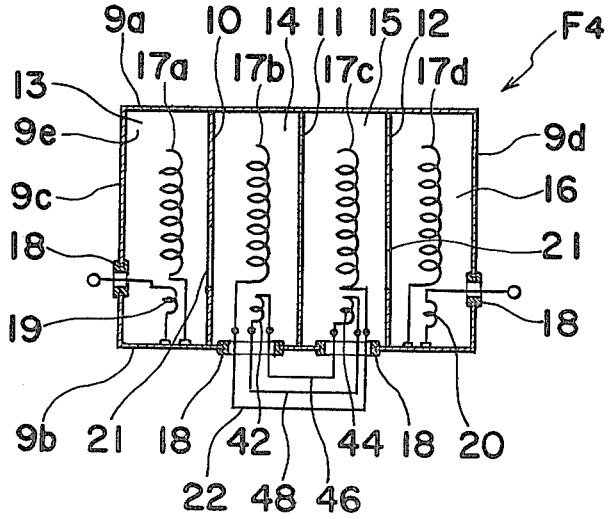

Note that the connection between the additional coils 42 and 44 may be in the opposite relation to that described above, as shown in FIG. 12.

The employment of the additional coils 42 and 44 is advantageous by further improving the cut off characteristic in the high frequency region for the following reason. The inductance $L_1$ of the additional coils 42 and 44 establishes a resonating circuit together with the equivalent capacitance $C_1$ resulting from the distibuted capacitance along the external lead lines 46 and 48 with a resonance frequency $f_1=\frac{1}{2}\pi\sqrt{L_1\cdot(C_1/2)}$. Since the capacitance $C_1$ is very low such as a few pF, attenuation occurs in the higher frequency region. Therefore, this attenuation contributes to improving the attenuation in the higher frequency region of the transmission characteristic of the band pass filter of the present invention.

Figure 13:
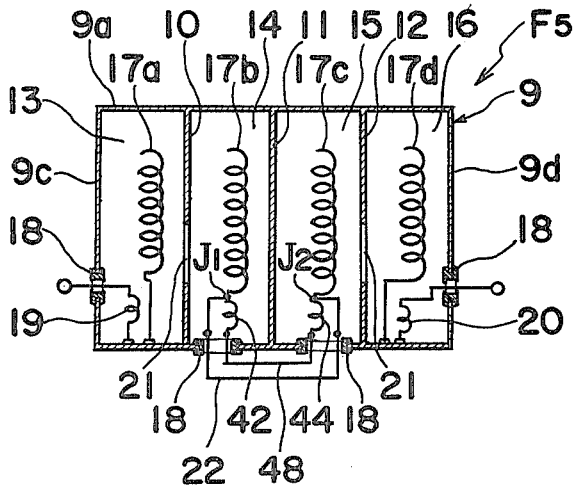

Referring to FIG. 13, there is shown a band pass filter $F_5$ which is another modification of the band pass filter $F_1$ described above. The band pass filter $F_5$ of this modification has the additional coils 42 and 44 connected in series to the quarter-wavelength windings 17*b* and 17*c*, respectively, through junctions $J_1$ and $J_2$. The junctions $J_1$ and $J_2$ are connected to each other through an external lead line 22. The ends of the additional coil 42 and 44 which are remote from the junctions are connected to each other through an lead line 48. In other words, the band pass filter $F_5$, in contrast to the band pass filter $F_3$, has the lead line 46 in common with the lead line 22.

The arrangement of the band pass filter $F_5$ described above is advantageous by reducing the ripples produced in the pass band of the filter and thus producing a less phase-distorted signal.

Figure 14:
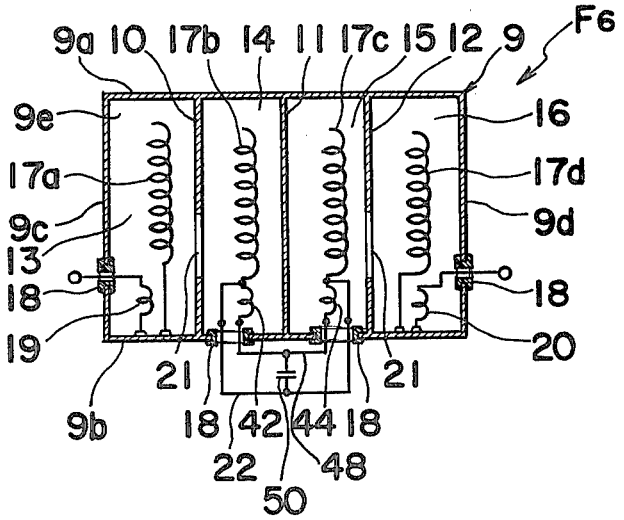
Figure 15:
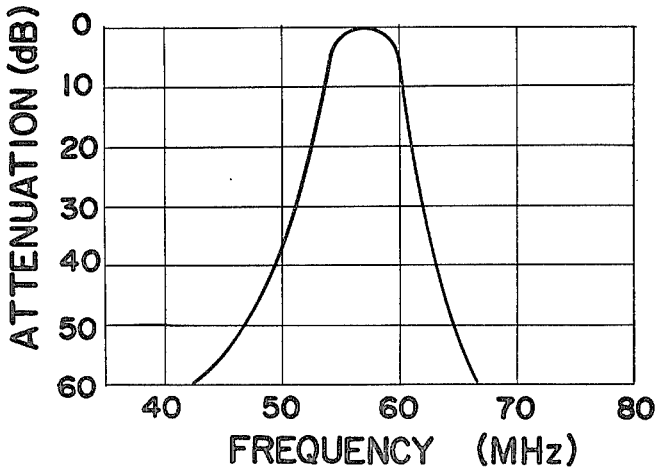
FIG. 15 is a graph showing the attenuation characteristic of the circuit shown in FIG. 14.

Note that the external lead wires establishing the distributed capacitance may be provided with a capacitor 50 as shown in FIG. 14. As described above, the inductance $L_1$ of the additional coils 42 and 44 establishes a resonating circuit together with capacitance $C_1$ of the capacitor 50 at resonance frequency $f_1=\frac{1}{2}\pi\sqrt{L_1\cdot(C_1/2)}$ (assuming the capacitance $C_1$ of capacitor 50 is much greater than the distributed capacitance along the lead lines 22 and 48). In the case where the inductance $L_1$ is 1.6 $\mu$H and the capacitance $C_1$ is 6 pF, the resonance frequency $f_1$ would be 72.6 MHz, so that the attenuation in the high frequency region would change rapidly, as shown in a graph of FIG. 15 showing the transmission characteristic.

The band pass filter $F_6$ shown in FIG. 14 has two additional coils 42 and 44. However, it is possible to eliminate either one of the coils 42 and 44 by doubling the capacitance of the capacitor 50, and yet retaining the same resonance frequency $f_1$ in the same manner. Since this capacitance is provided for establishing a resonating circuit with the additional coil, this capacitance can be established between the additional coil and the casing by inserting one or more suitable capacitors therebetween.

Furthermore, the capacitor 50, which has been described as connected between the lead lines 48 and 22 in FIG. 14, may be replaced by a variable capacitor for the purpose of precise adjustment of the cut off characteristic in the high frequency region and also in the low frequency region.

As described fully in the foregoing description, since the band pass filter of the present invention has no coupling opening formed in the partition wall separating the helical resonators positioned intermediately between the first helical resonator for receiving input signal from the additional input coil and the last helical resonator for producing filtered output signal from the additional output coil, no distributed capacitance is produced between the intermediately positioned helical resonators.

For the purpose of obtaining a gradual change in the cut off characteristic of the band pass filter of the present invention, it is possible to form a suitable opening or aperture in the partition wall 11 in a known manner.

Figure 16:
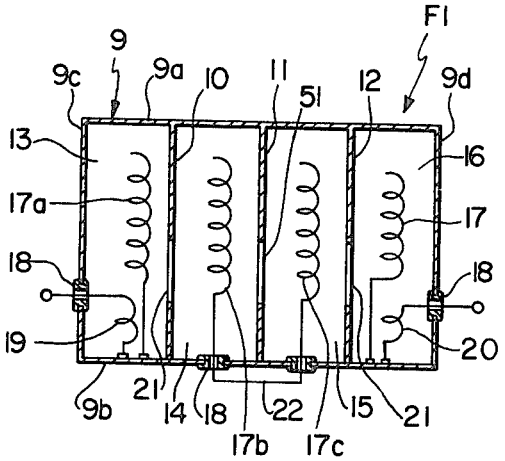
FIG. 16 is a view similar to FIG. 5, but particularly showing another embodiment of the present invention.

Referring to FIG. 16, there is illustrated a coupling opening 51 in the partition wall 11 similar to the opening 21 found in partition walls 10 and 12. The signals appearing in quarter-wavelength windings 17b and 17c are coupled to each other through coupling opening 51 as well as through lead line 22 like the previously described embodiments.

Moreover, since the band pass filter of the present invention has such a sharp cut-off characteristic in the high frequency region, trap circuits employed in the television set for trapping adjacent channel audio carrier wave signals having frequency $f_s'$ and for trapping adjacent channel video carrier wave signals having frequency of $f_p'$may be provided by a simple construction retaining high quality when the band pass filter of the present invention is employed in the intermediate frequency filter. Furthermore, such an intermediate frequency filter employing the band pass filter of the present invention sharply separates the intermediate frequency and yet maintains the attenuation of self-audio carrier wave signals, the video carrier wave signals and the video sub-carrier wave signals to the appropriate degree.

Although the present invention has been fully described by way of examples with reference to the accompanying drawings, note that various changes and modifications are apparent to those skilled in the art. For example, helical resonators can be previously mounted on a substratum made of, for example, synthetic resin before being housed in each of the rooms. Therefore, unless such changes and modifications depart from the true scope of the present invention, they should be construed as included therein.

What is claimed is:

1. A band pass filter comprising in combination:

a metallic shield casing in the shape of a box-like chamber;

at least one metallic partition wall electrically connected to and disposed within said box-like chamber for dividing said box-like chamber into at least two enclosed spaces which are substantially electrically shielded from each other;

a quarter-wavelength winding, having first and second ends, disposed within each of said enclosed spaces and electrically insulated from said shield casing;

a first connecting means, electrically insulated from said shield casing, connected to said first end of each of said quarter-wavelength windings for electrically connecting said quarter-wavelength windings;

an input means coupled to a first of said enclosed spaces for supplying an input signal to said first enclosed space; and an output means coupled to a second of said enclosed spaces for producing an output signal from said second enclosed space.

2. A band pass filter as claimed in claim 1, wherein said quarter-wavelength, winding housed in each of said enclosed spaces comprises a helical coil.

3. A band pass filter as claimed in claim 1, wherein said partition wall has an opening formed therein.

4. A band pass filter as claimed in claim 1 wherein said quarter-wavelength winding in each of said enclosed spaces has said first end thereof rigidly supported within and electrically insulated from said shield casing and has said second end thereof disposed in a position spaced from said shield casing and said partition wall constituting the walls of said enclosed space.

5. A band pass filter as claimed in claim 1 further comprising:

an additional coil, having two ends, disposed within each of said enclosed spaces and inductively coupled to said quarter-wavelength winding disposed within said enclosed space;

a second connecting means, electrically insulated from said shield casing, connected to one end of each of said additional coils for electrically connecting said additional coils; and a third connecting means, electrically insulated from said shield casing, connected to the other end of each of said additional coils not connected to said second connecting means for electrically connecting said additional coils.

6. A band pass filter as claimed in claim 1 further comprising:

an additional coil, having first and second ends, disposed within each of said enclosed spaces adjacent to and inductively coupled to said quarter-wavelength winding disposed within said enclosed space, having said first end thereof electrically connected to said first end of said quarter-wavelength winding disposed within said enclosed space; and a second connecting means, electrically insulated from said shield casing, connected to said second end of each of said additional coils for electrically connecting said additional coils.

7. A band pass filter as claimed in claim 6 further comprising a capacitor connected between said first and second connecting means.

8. A band pass filter as claimed in claim 7, wherein said capacitor is a variable capacitor.

9. A band pass filter as claimed in claim 1, wherein said shield casing includes an input opening disposed therein and said input means comprises:

an input means metallic partition wall having an opening disposed therein, electrically connected to said shield casing, disposed within said first enclosed space for dividing said first enclosed space into an input portion including said input opening and a resonator portion having said quarter-wavelength winding disposed therein;

an input quarter-wavelength winding, having first and second ends, disposed within said input portion of said first enclosed space, having said first end thereof rigidly mounted on and electrically connected to said shield casing and said second end thereof disposed in a position spaced from said shield casing and said input means metallic partition wall constituting the walls of said input portion of said first enclosed space;

an input insulating support means disposed on the periphery of said input opening in said shield casing; and an input auxiliary coil, having first and second ends, disposed within said input portion of said first enclosed space inductively coupled to said input quarter-wavelength winding, having said first end rigidly mounted on and electrically connected to said shield casing and said second end passing out of said box-like chamber through said input opening and electrically insulated from said shield casing by said input insulating support means.

10. A band pass filter as claimed in claim 1, wherein said shield casing includes an output opening disposed therein and said output means comprises:

an output means metallic partition wall, having an opening disposed therein, electrically connected to said shield casing disposed within said second enclosed space for dividing said second enclosed space into an output portion including said output opening and a resonator portion having said quarter-wavelength winding disposed therein;

an output quarter-wavelength winding, having first and second ends, disposed within said output portion of said second enclosed space, having said first end thereof rigidly mounted on and electrically connected to said shield casing and said second end thereof disposed in a position spaced from said shield casing and said output means metallic partition wall constituting the walls of said output portion of said second enclosed space;

an output insulating support means disposed on the periphery of said output opening in said shield casing; and an output auxiliary coil, having first and second ends, disposed within said output portion of said second enclosed space inductively coupled to said output quarter-wavelength winding, having said first end rigidly mounted on and electrically connected to said shield casing and said second end passing out of said box-like chamber through said output opening and electrically insulated from said shield casing by said output insulating support means.

11. A band pass filter comprising in combination:

a metallic shield casing in the shape of a box-like chamber;

a supporting plate disposed within said shield casing approximately at the center of said box-like chamber;

two quarter-wavelength windings aligned with each other having first and second ends, disposed within said box-like chamber, having said first end thereof rigidly mounted on and electrically insulated from said supporting plate and said second end thereof disposed in a position spaced from said shield casing;

a connecting means electrically insulated from said supporting plate, connected to said first ends of said two quarter-wavelength windings for electrically connecting said quarter-wavelength windings;

an input means coupled to said box-like chamber for supplying an input signal to said box-like chamber; and an output means coupled to said box-like chamber for producing an output signal from said box-like chamber.

* * * * *